US005240803A

United States Patent [19]

Ota

[11] Patent Number: 5,240,803

[45] Date of Patent: Aug. 31, 1993

[54] TONER FOR DEVELOPING STATICALLY CHARGED IMAGES AND PROCESS FOR PREPARATION THEREOF

[75] Inventor: Hideki Ota, Ikoma, Japan

[73] Assignee: Mita Industrial Co., Ltd., Osaka, Japan

[21] Appl. No.: 851,250

[22] Filed: Mar. 13, 1992

Related U.S. Application Data

[63] Continuation of Ser. No. 573,771, Aug. 28, 1990, abandoned.

[30] Foreign Application Priority Data

Aug. 29, 1989 [JP] Japan ..... 1-222071

[51] Int. Cl.[5] ..... G03G 9/08

[52] U.S. Cl. ..... 430/106; 430/110; 430/904

[58] Field of Search ..... 430/106, 110, 904

[56] References Cited

U.S. PATENT DOCUMENTS 4,888,263 12/1989 Tomita et al. ..... 430/110

4,950,575 8/1990 Shiozaki et al. ..... 430/110

*Primary Examiner*—Marion E. McCamish

*Assistant Examiner*—S. Rosasco

*Attorney, Agent, or Firm*—Sherman and Shalloway

[57] ABSTRACT

A toner for developing statically charged images, comprising a binder resin, a colorant and a charge-controlling dye and a process for the preparation of this toner are disclosed. This toner consisting of particles composed of these components have a circularity of from 0.95 to 1.0, and the concentration of the dye on the surfaces of the toner particles is from $1.0\times10^{-3}$ to $4\times10^{-3}$ g/g. By dint of these characteristic features, the stability of the frictional chargeability characteristics of the toner is increased, and the contamination of a carrier, a developing device or the like with the dye can be prevented.

9 Claims, No Drawings

TONER FOR DEVELOPING STATICALLY CHARGED IMAGES AND PROCESS FOR PREPARATION THEREOF

This application is a continuation of application Ser. No. 07/573,771, filed Aug. 28, 1990, now abandoned.

BACKGROUND OF THE INVENTION (1) Field of the Invention

The present invention relates to a toner for developing statically charged images, which is used for the electrophotography and the like. More particularly, the present invention relates to a long-life toner for developing statically charged images, in which stable frictional charging characteristics are obtained without contamination of a frictional charging member such as a carrier.

(2) Description of the Related Art

A toner for developing statically charged images, which is used in the field of the electrophotography or the like, is composed of colored resin particles having a particle size of 5 to 20 μm, which comprise a resin binder and, dispersed therein, a colorant, a charge-controlling dye and the like. A resin having a desired electroscopic property and a desired binding property, such as a styrene resin, is used as the resin binder. An organic or inorganic coloring pigment such as carbon black is used as the colorant. A nigrosine compound, a monoazo dye or a metal complex of salicylic acid or naphthoic acid is used as the charge-controlling dye. Most typically, this toner for developing statically charge images is prepared according to the so-called pulverization method comprising melt-kneading a resin binder with a colorant and a charge-controlling dye, cooling the kneaded composition, pulverizing the cooled solid product and classifying the pulverized product to adjust the particle size within a certain range. However, the yield of the toner thus obtained through pulverization and classification is very low, and large equipment is necessary for the production and the manufacturing cost of the toner is very large. Moreover, the toner particles obtained according to the pulverization method is irregular in the shape and hence, the flowability of the toner is generally low and blocking is often caused. Accordingly, for overcoming these defects of the toner having an indeterminate shape, which is provided according to the pulverization method, trials have been made to improve the flowability and frictional chargeability by preparing shperical toner particles. This spherical toner is prepared according to the spray-drying method comprising dissolving or dispersing a binder resin, a colorant, a charge-controlling dye and the like into an organic solvent such as toluene and spray-drying the resin solution or dispersion to obtain a toner, or the suspension polymerization method comprising suspending a polymerizable composition comprising a polymerizable monomer forming a binder resin, a colorant, a charge-controlling agent and the like into an aqueous dispersion medium and directly forming a toner by carrying out the polymerization reaction. This spherical toner has a higher flowability than the toner having an indeterminate shape, and the spherical toner shows a better stirrability in a stirrer and a better conveyability. Moreover, the spherical toner is advantageous in that the contact area among toner particle or the contact area between the toner and a frictional charging member such as a magnetic carrier (in case of a two-component type developer) is large, effective friction is performed among particles and because of a good flowability as well as these characteristics, frictional charging can be effected uniformly and efficiently.

However, as the result of investigations made by us, it was found that the spherical toner involves the following problem. Namely, in a toner consisting of particles rendered spherical to a certain level, the effective area for the contact and friction in the surfaces of the particles in large and the mobility of the toner particles is increased, and therefore, the frictional charging efficiency is increased and the rising characteristics at the charging are enhanced. However, the charge-controlling dye present on the surfaces of the particles are dropped by sharp frictional stirring, and the dropped charge-controlling dye stains the surface of the frictional charging member such as the carrier and gradually renders the frictional chargeability characteristics unstable. Therefore, as the copying operation is continued, image fogging or reduction of the image density is caused.

SUMMARY OF THE INVENTION

Under the above-mentioned background, the present invention has been completed, and it is a primary object of the present invention to provide a spherical toner in which stable friction chargeability characteristics can be maintained over a long period with no contamination of a friction charging member such as carrier particles or a stirring member arranged in a developing device, and a process for the preparation of this spherical toner.

Another object of the present invention is to provide a toner capable of forming clear images having a high resolving powder and a high image density without fogging stably over a long period, and a process for the preparation of this toner.

In accordance with one aspect of the present invention, there is provided a toner for developing statically charged images, which comprises a binder resin and, dispersed therein, at least a colorant and a charge-controlling dye, wherein the toner consists of spherical particles having a circularity, defined by the following formula (1), of from 0.95 to 1:

$$\text{Circularity } (D) = \frac{\sqrt{r_L \cdot r_S}}{r_L} \quad (1)$$

wherein $r_L$ represents the long radius of the toner particles and $r_S$ represents the short radius of the toner particles, and the surface dye concentration is from $1\times10^{-3}$ to $4\times10^{-3}$ g/g.

In the present invention, it is preferred that the dye should adhere uniformly in the form of a thin layer to the surfaces of the particles.

Furthermore, in the present invention, it is preferred that the median diameter based on the volume of the spherical particles be from 5 to 11 μm and $D_{25}/D_{75}$ indicating the dispersion of the particle diameter be in the range of from 1.2 to 1.6.

Moreover, it is preferred that the spherical particles by polymer particles prepared directly by the suspension polymerization.

In accordance with another aspect of the present invention, there is provided a process for the preparation of a toner for developing statically charged images, which comprises forming spherical particles comprising a binder resin and, dispersing therein, at least a colorant and a charge-controlling dye and having a circularity, defined by the following formula (1), of from 0.95 to 1:

$$\text{Circularity } (D) = \frac{\sqrt{r_L \cdot r_S}}{r_L} \quad (1)$$

wherein $r_L$ represents the long radius of the toner particles and $r_S$ represents the short radius of the toner particles, immersing the spherical particles in an organic solvent capable of dissolving or dispersing the charge-controlling dye therein but incapable of dissolving the resin component therein, and thereby sticking the charge-controlling dye uniformly to the entire surfaces of the particles while washing away the unnecessary portion of the charge-controlling dye present on the surfaces of the particles.

In the present invention, it is preferred that the dye concentration on the surfaces of the final particles be adjusted to $1\times10^{-3}$ to $4\times10^{-3}$ g/g.

Furthermore, in the present invention, it is preferred that the spherical particles having a circularity within the above-mentioned range be polymer particles obtained by suspending a polymerizable composition comprising at least a polymerizable monomer, a colorant and a charge-controlling dye in an amount of at least 0.1% by weight based on the polymerizable monomer in an aqueous phase and subjecting the suspension to polymerization reaction, which have a median diameter based on the volume of from 5 to 11 μm and $D_{25}/D_{75}$, indicating the dispersion of the particle diameter, of from 1.2 to 1.6.

The surface dye concentration referred to in the instant specification is determined in the following manner. Namely, 100 mg of a toner consisting of particles having a circularity within the above-mentioned range and an average particle diameter of 3 to 20 μm is precisely weighed, and 50 ml of methanol is added to the toner. The mixture is sufficiently stirred for 10 minutes in a ball mill and is allowed to stand still for 10 minutes, and the concentration of the supernatant is measured by an absorptiometer and the concentration is calculated according to Lambert-Beer's law.

The diameters of the particles are measured by a Coulter Counter, and the measured diameters are cumulated in order from the small diameter and the diameter observed when diameters of 25% by volume of particles are cumulated is designated as the 25% cumulative diameter ($D_{25}$) based on the volume. Similarly, the diameters measured by a Coulter Counter are cumulated in order from the small diameter and the diameter observed when diameters of 75% by volume of particles are cumulated is designated as the 75% cumulative diameter ($D_{75}$) based on the volume.

DETAILED DESCRIPTION OF THE PREFERRED EMBODIMENTS

The present invention is characterized in that the shape of toner particles is made substantially spherical and the dye concentration on the surfaces of the toner particles is adjusted within a specific range.

The charge-controlling dye promotes generation of charges in the toner and is used for increasing the saturation charge quantity and improving the rising characteristics at the charging. Accordingly, at the frictional charging with a frictional charging member, it is preferred that the charge-controlling agent be present on the surfaces of the toner particles. However, most of charge-controlling dyes are hydrophilic and they do not always show a good compatibility with binder resins. Accordingly, if the concentration of the dye present on the surfaces of the toner particles exceeds a certain level, the amount of the dye not sufficiently fixed to the surfaces of the particles increases, and therefore, the dye is often caused to drop by the frictional contact among the toner particles or by the frictional contact of the toner particles with the frictional charging member such as carrier particles. This disadvantage is especially conspicuous in case of spherical toner particles having excellent stirring and friction efficiencies.

In the present invention, in the substantially spherical toner in which the circularity represented by the above-mentioned formula (1) is from 0.95 to 1, the surface dye concentration is controlled to up to $4\times10^{-3}$ g/g, whereby the amount of the dye dropping at the friction and stirring is reduced. Namely, by good stirrability and flowability possessed by substantially spherical particles, the frequency of the contact with the frictional charging member is increased, and stable frictional charging characteristics are attained at a lowest necessary dye concentration. If the dye concentration is too low, a desired charge quantity cannot be obtained from the initial stage, and if the surface dye concentration is lower than $1\times10^{-3}$ g/g, no good image can be formed. Moreover, even if the surface dye concentration is within the above-mentioned range, if the circularity of the particles is lower than 0.95, the frequency of the frictional contact is reduced and the charge quantity of the toner cannot be increased to an appropriate level, with the result that no good development can be performed.

In the present invention, the preparation process is not particularly critical, so far as particles having a surface dye concentration within the above-mentioned range and a circularity of from 0.95 to 1 are obtained. However, there can be adopted a process in which a substantially spherical toner having a surface dye concentration exceeding the above-mentioned range is first formed and the surface dye concentration is then adjusted within the above-mentioned range. In this case spherical toner particles having a surface dye concentration exceeding the above-mentioned range are immersed in an organic solvent capable of dissolving or dispersing the charge-controlling dye therein but incapable of dissolving the resin component therein and the excess of the dye present on the surfaces is washed away. According to this process, the unnecessary portion of the dye is washed away, and the life of the toner can be further prolonged. Incidentally, if the dye has a high compatibity with the surfaces of the toner particles, the unnecessary portion of the dye thus washed away is adsorbed at non-dye-fixed parts of the particle surfaces again, and as the result, the dye is uniformly fixed to the particle surfaces. In the case where the spherical toner of the present invention is prepared according to the suspension polymerization process, the polymerization is carried out in the state where oil drop particles are suspended or dispersed in the aqueous phase, and the charge-controlling dye is apt to be distributed predominantly on the surfaces of the oil drop particles during the polymerization and by the above-mentioned immersion treatment in an organic solvent, fixation of the dye and removal of the residual monomer component in the toner particles can be simultaneously accomplished. Accordingly, the moisture resistance and durability of the toner can be improved.

Materials used when the toner is directly prepared by the suspension polymerization will now be described.

Various monomers of the addition polymerization type can be used as the monomer for forming a binder resin by polymerization.

As suitable examples of the monomer, there can be mentioned vinyl aromatic polymers, acrylic monomers, vinyl ester monomers, vinyl ether monomers, diolefin monomers and mono-olefin monomers.

As the vinyl aromatic monomer, there can be mentioned monomers represented by the following formula:

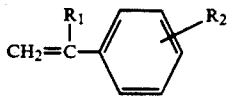

(2)

wherein $R_1$ represents a hydrogen atom, a lower alkyl group or a halogen atom, and $R_2$ represents a hydrogen atom, a lower alkyl group, a halogen atom, an alkoxy group, a nitro group or a vinyl group, such as styrene, α-methylstyrene, vinyltoluene, α-chlorostyrene, o-, m- and p-chlorostyrenes, p-ethylstyrene and divinylbenzene and mixtures thereof.

As the acrylic monomer, there can be mentioned monomers represented by the following formula:

$$CH_3{=}C(R_3){-}CO{-}O{-}R_4 \quad (3)$$

wherein $R_3$ represents a hydrogen atom or a lower alkyl group, and $R_4$ represents a hydrogen atom, a hydrocarbon group having up to 12 carbon atoms, a hydroxyalkyl group or a vinylester group, such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, ethylene glycol dimethacrylate and tetraethylene glycol dimethacrylate.

As the vinyl ester, there can be mentioned monomers represented by the following formula:

$$CH_2{=}CH{-}O{-}C(=O){-}R_5 \quad (4)$$

wherein $R_5$ represents a hydrogen atom or a lower alkyl group, such as vinyl formate, vinyl acetate and vinyl propionate.

As the vinyl ether, there can be mentioned monomers represented by the following formula:

$$CH_2{=}CH{-}O{-}R_6 \quad (5)$$

wherein $R_6$ represents a monovalent hydrocarbon group having up to 12 carbon atoms, such as vinyl-n-butyl ether, vinylphenyl ether and vinylcyclohexyl ether.

As the diolefin, there can be mentioned monomers represented by the following formula:

$$CH_2{=}C(R_7){-}C(R_8){=}CH{-}R_9 \quad (6)$$

wherein $R_7$, $R_8$ and $R_9$ each represent a hydrogen atom, a lower alkyl group or a halogen atom, such as butadiene, isoprene and chloroprene.

As the mono-olefin, there can be mentioned monomers represented by the following formula:

$$CH_2{=}C(R_{10}){-}R_{11} \quad (11)$$

wherein $R_0$ and $R_{11}$ each represent a hydrogen atom or a lower alkyl group, such as ethylene, propylene, isobutylene, butene-1, pentene-1 and 4-methylpentene-1.

These monomers can be used alone or in the form of mixtures of two or more of them. From the viewpoint of the fixing property, it is preferred that a monomer composed mainly of at least one member selected from the group consisting of styrene, acrylic acid esters and methacrylic acid esters.

A charge-controlling monomer having a polar group can be used for further stabilizing the chargeability characteristics of the toner. For example, as the monomer having an anionic group, there can be mentioned maleic anhydride, crotonic acid, tetrahydromaleic anhydride, styrene-sulfonic acid and 2-acrylamido-2-methylpropane-sulfonic acid. As the monomer having a cationic group, there can be mentioned dimethylaminoethyl (meth)acrylate, diethylaminoethyl (meth)acrylate, N-aminoethylaminopropyl (meth)acrylate, vinylpyridine, 2-vinylimidazole and 2-hydroxy-3-acryloxypropyl trimethylammonium chloride. When an anionic or cationic group-containing monomer as mentioned above is used, the monomer is preferably contained in an amount of about 0.01 to about 10% by weight based on the above-mentioned polymerizable monomer.

Known pigments and dyes (inclusively called "coloring pigments" hereinafter) customarily used in this field, as described below, can be used as the colorant to be contained in the polymerizable monomer.

Black Pigments

Carbon black, acethylene black, lamp black and aniline black.

Yellow Pigments

Chrome yellow, zinc yellow, cadmium yellow, yellow iron oxide, Mineral Fast Yellow, nickel titanium yellow, naples yellow, Naphthol Yellow S, Hansa Yellow G, Hanse Yellow 10G, Benzidine Yellow G, Benzidine Yellow GR, Quinoline Yellow Lake, Permanent Yellow NCG and Tartrazine Lake.

Orange Pigments

Chrome orange, molybdenum orange, Permanent Orange GTR, Pyrazolone Orange, Vulcan Orange, Indanthrene Brilliant Orange RK, Benzidine Orange G and Indanthrene Brilliant Orange GK.

Red Pigments

Red iron oxide, cadmium red, red lead, mercury cadmium sulfide, Permanent Red 4R, Lithol Red, Pyrazolone Red, Watchung Red calcium salt, Lake Red D, Brilliant Carmine 6B, Eosine Lake, Rhodamine Lake B, Alizarin Lake and Brilliant Carmine 3B.

Violet Pigments

Manganese violet, Fast Violet B and Methyl Violet Lake.

Blue Pigments

Iron blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments

Chrome green, chromium oxide, Pigment Green B, Malachite Green Lake and Fanal Yellow Green G.

White Pigments

Zinc flower, titanium oxide, antimony white and zinc sulfide.

Extender Pigments

Baryte powder, barium carbonate, clay, silica, white carbon, talc and alumina white.

The coloring pigment is used in an amount of 0.1 to 50 parts by weight, preferably 1 to 20 parts by weight, per 100 parts by weight of the above-mentioned polymerizable monomer.

A magnetic pigment can be incorporated into the toner for imparting magnetic properties thereto.

As the magnetic pigment, there have been used triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), gadolinium iron oxide ($Gd_3Fe_5O_{12}$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic materials can optionally be used in the present invention.

It is preferred that the magnetic pigment be incorporated in an amount of 1 to 200 parts by weight, especially 5 to 100 parts by weight, per 100 parts by weight the above-mentioned polymerizable monomer.

Known charge-controlling dyes customarily used in this field can be used as the charge-controlling agent to be incorporated in the polymerizable monomer in the present invention. For example, there can be mentioned oil-soluble dyes such as Oil Black, metal soaps, that is, salts of metals such as manganese, iron, cobalt, lead, zinc, cerium, calcium and nickel with higher fatty acids, resin acids and the like, metal complex salt azo dyes containing metals such as chromium, copper, iron, cobalt, nickel and aluminum, and metal complex compounds of salicylic acid, an alkylsalicylic acid and naphthoic acid with metals such as zinc and chromium. In view of the fixation to the binder resin, a metal-containing complex salt azo dye is preferably used, and a metal-containing complex salt azo dye soluble in an alcohol in which the binder resin is insoluble is especially preferably used. It is preferred that the charge-controlling dye be incorporated in an amount of at least 0.1% by weight based on the above-mentioned polymerizable monomer, especially about 0.1 to about 3 parts by weight per 100 parts by weight of the polymerizable monomer. If the amount incorporated of the charge-controlling dye is smaller than 0.1% by weight, the dye concentration on the tone surface becomes too low at the immersion treatment, described below, of the toner particles in an organic solvent.

Known additives customarily used in this field can be incorporated into the toner in addition to the above-mentioned colorant and charge-controlling dye in the present invention.

For example, a wax such as low-molecular-weight polypropylene, low-molecular-weight polyethylene or paraffin wax, a polymer of an olefin having at least 4 carbon atoms, a fatty acid amide, or a silicone oil can be incorporated as the offset-preventing agent in an amount of 0.1 to 10 parts by weight per 100 parts by weight of the polymerizable monomer.

A charge-controlling resin can be incorporated for controlling the charge in addition to the charge-controlling dye. The charge-controlling resin is a resin component comprising the above-mentioned monomer having a polar group as the constituent, and a homopolymer of the monomer having a polar group or a copolymer of the monomer having a polar group with other monomer of the addition polymerization type, which has been synthesized in advance by the solution polymerization or bulk polymerization, is used as the charge-controlling resin. The charge-controlling resin is preferably used in an amount of about 0.1 to about 10 parts by weight per 100 parts by weight of the polymerizable monomer.

Known dispersion stabilizers customarily used for the suspension polymerization can be used as the dispersion stabilizer when a polymerizable composition comprising the above-mentioned polymerizable monomer and the above-mentioned additives is suspended and dispersed in an aqueous phase. In view of the stability of particles and the easiness in removing the dispersion stabilizer from polymer particles formed by the polymerization, it is preferred that an inorganic dispersant be used as the dispersion stabilizer, and a fine powder of a hardly water-soluble inorganic salt is especially preferably used. For example, there can be mentioned calcium sulfate, tricalcium phosphate, magnesium carbonate, barium carbonate, calcium carbonate, aluminum hydroxide and silica. The dispersant is incorporated in an amount of 0.001 to 10 parts by weight, especially about 0.005 to about 5 parts by weight, per 100 parts by weight of water.

As the polymerization initiator, there can be used oil-soluble initiators, for example, azo compounds such as azobisisobutyronitrile, and peroxides such as cumene hydroperoxide, t-butyl hydroperoxide, dicumyl peroxide, di-t-butyl peroxide, benzoyl peroxide and lauroyl peroxide. Furthermore, ionizing radiations such as-rays and accelerated electron beams, and various sensitizing agents can be used in combination with the foregoing initiators.

The reaction conditions can be optionally selected. It is preferred that the stirring speed for forming dispersed oil drops be 3000 to 200000 rpm, especially 5000 to 15000 rpm, and stirring is performed so that the particles size of the suspended oil drops is 5 to 11 $\mu$m, especially 7 to 10 $\mu$m. The polymerization initiator such as an azo compound, or a peroxide is incorporated in a so-called catalytic amount, and preferably, the polymerization initiator is preferably incorporated in an amount of 0.1 to 10% weight based on the charged monomer, known polymerization-initiating temperature and polymerization time conditions can be adopted, and it is generally sufficient if the polymerization is carried out at a temperature of 40° to 100° C. for 1 to 50 hours. Stirring of the reaction mixture may be such gentle stirring that homogeneous reaction is caused as a whole. In order to control inhibition of the polymerization by oxygen, the polymerization can be carried out while replacing the reaction atmosphere with an inert gas such as nitrogen. The polymer product obtained by the reaction is recovered by solid-liquid separation utilizing filtration, and the recovered product is washed with water and treated with a dilute acid to obtain toner particles. As described hereinbefore, the toner of the present invention can be prepared at a high efficiency in a short time by this suspension polymerization. The preparation process is not particularly critical, so far as a toner having the above-mentioned circularity and surface dye concentration. For example, there can be adopted the so-called spray-drying process in which a binder resin such as a styrene/acrylic copolymer, a polyester resin or an epoxy resin, a colorant and a charge-controlling dye are dissolved or dispersed in an organic solvent such as toluene and the solution or dispersion is sprayed and granulated. Adjustments are made so that the circularity of the toner particles is within the above-mentioned range, the median diameter $D_{50}$ based on the volume is 5 to 11 μm, preferably 7 to 10 μm, and $D_{25}/D_{50}$ indicating the dispersion of the particle size is from 1.2 to 1.6. If the toner has these particles size characteristics, the flowability and stirrability of the toner particles are improved and the charging characteristics are improved, and a sharp toner image having a very high resolving power can be obtained.

The immersion treatment of the toner in an organic solvent will now be described.

An organic solvent capable or dissolving of dispersing the charge-controlling agent but incapable of dissolving the binder resin is used in the operation of immersing and stirring the toner particles in the organic solvent for adjusting the dye concentration in the toner. As specific examples of the organic solvent, there can be mentioned alcohols such as methanol, ethanol, propanol, isobutanol, tert-butanol, hexanol and octanol, aliphatic hydrocarbons such as n-hexane, pentane, heptane, octane, iso-octane, decane, 2,2'-dimethylbutane and chlorobenzene, carbon halides such dichloromethane, dichloroethane, carbon tetrachloride and chlorobenzene, ethers such as dioxane, dimethyl ether, diethyl ether and tetrahydrofuran, ketones such as acetone, methylethylketone and cyclohexanone, and acetonitrile, formaldehyde and dimethylformamide. These organic solvents are used singly or in the form of mixtures of two or more of them. The toner particles having a surface dye concentration higher than the predetermined level are immersed in an organic solvent as mentioned above, and the unnecessary dye present on the surfaces of the toner particles is washed away with stirring, whereby the surface dye concentration is adjusted to $1\times10^{-3}$ to $4\times10^{-3}$ g/g, preferably $1.5\times10^{-3}$ to $3\times10^{-3}$ g/g.

Gentle stirring conducted at a stirring speed of 30 to 100 rpm is generally sufficient, and the treatment time is about 0.01 to about 60 hours.

The treated toner is taken out from the solvent and is then dried to obtain a final toner.

The spherical toner having a circularity of from 0.95 to 1 and a surface dye concentration of $1\times10^{-3}$ to $4\times10^{-3}$ g/g can be mixed with fine particles of a metal oxide such as hydrophobic silica or alumina or fines particles of a resin such as polystyrene or PMMA to form a toner composition.

The magnetic carrier to be mixed with the toner of the present invention will now be described.

In the case where the toner of the present invention is used in the form of a two-component type developer formed by mixing the toner of the present invention with a magnetic carrier, known magnetic carriers customarily used in this field can be used as the magnetic carrier. However, in general, ferrite particles giving a soft magnetic brush are preferably used, and ferrite particles having the surfaces coated with a high-resistance resin layer are especially preferably used.

Spherical ferrite particles are preferably used, and it is preferred that the particle size be 20 to 150 μm, especially 50 to 120 μm.

Sintered ferrite particles composed of at least one member selected from the group consisting of zinc iron oxide ($ZnFe_2O_4$), yttrium iron oxide ($Y_3Fe_5O_{12}$), gadolinium iron oxide ($Gd_3Fe_5O_{12}$), copper iron oxide ($CuFe_2O_4$), lead iron oxide ($PbFe_{12}O_{19}$), neodymium iron oxide ($NdFe_2O_4$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) are used as the ferrite. Soft ferrites comprising a metal component selected from the group consisting of Cu, Zn, Mg, Mn and Ni, especially at least two metal components, for example, a copper/zinc/magnesium ferrite, are especially preferably used.

At least one member selected from the group consisting of silicone resins, fluorine resins, acrylic resins, styrene resins, styrene-acrylic resins, olefin resins and phenolic resins can be used as the coating resin for coating the surfaces of carrier particles.

The toner of the present invention is mixed with the magnetic carrier so that the toner concentration is 1 to 10% by weight, especially 3 to 8% by weight, whereby a developer is formed.

The present invention will now be described in detail with reference to the following examples and comparative examples.

EXAMPLE 1

A polymerizable composition comprising 80 parts by weight of styrene, 20 parts by weight of 2-ethylhexyl methacrylate, 5 parts by weight of grafted carbon black, 1 part by weight of a chromium-containing complex salt azo dye (Spiron Black TRH supplied by Hodogaya Kagaku), 0.5 part of divinylbenzene and 2 parts by weight of ADVN was thrown into 480 parts by weight of water containing 0.086% of tricalcium phosphate as the dispersion stabilizer and 0.005% of sodium dodecylbenzene-sulfonate and the polymerizable composition was dispersed at 11500 rpm for 10 minutes by using a TK homomixer (supplied by Tokushu Kika Kogyo). Polymerization was carried out at 80° C. in a nitrogen atmosphere for 10 hours to obtain a suspension containing polymer particles. As the result of the Coulter Counter measurement of the obtained particles, it was found that the medium diameter based on the volume was 9.8 μm and the dispersion expressed by $D_{25}/D_{75}$ was 1.47. The circularity was 0.98 as calculated by an image analyzer. The obtained particles were washed with hydrochloric acid to remove the adhering residual tricalcium phosphate by dissolution. Then, the particles were washed with water and then immersed and stirred in 400 parts by weight of methanol for 3 minutes. The particles were recovered by filtration and dried to obtain a toner. When the surface dye concentration in the toner was measured, it was found that the surface toner concentration was $2.6\times10^{-3}$ g/g. A developer having a toner concentration of 3% was prepared by using this toner and a ferrite carrier. In a copying machine (Model DC-111C supplied by Mita Kogyo), the printing test of the obtained developer was carried out under normal temperature and normal relative humidity conditions (20° C. and 60%) and under high temperature and high relative humidity conditions (35° C. and 85%). It was found that throughout 20000 prints, the image quality or the charge quantity was hardly changed, and sharp and clear images were always obtained. The magnetic carrier or the interior of the developing device was hardly contaminated with the dye.

The obtained results are shown in Tables 1 and 2.

EXAMPLE 2

Polymerization was carried out in the same manner as described in Example 1 except that the amount added of Spiron Black TRH as the charge-controlling dye was changed to 0.3 part by weight. The obtained particles were not washed with methanol, but were washed with hydrochloric acid, washed with water and dried to obtain a toner. The surface dye concentration in the obtained toner was $2.5\times10^{-3}$ g/g, the median diameter based on the volume was 10.2 μm, the dispersion ($D_{25}/D_{75}$) was 1.46, and the circularity was 0.99. The printing test was carried out in the same manner as described in Example 1. Throughout 20000 prints, the image quality or the charge quantity was not substantially changed and was maintained at an appropriate level. Furthermore, the magnetic carrier or the interior of the developing device was hardly contaminated with the dye.

The obtained results are shown in Tables 1 and 2.

EXAMPLE 3

A toner was prepared in the same manner as described in Example 1 except that 1 part by weight of a zinc complex salt of an alkylsalicylic acid (Bontron E-84 supplied by Orient Kagaku) was used as the charge-controlling dye. The surface dye concentration in the obtained toner was $2.9\times10^{-3}$ g/g, the median diameter based on the volume was 8.9 μm, the dispersion ($D_{25}/D_{75}$) was 1.52, and the circularity was 0.99. The printing test was carried out in the same manner as described in Example 1. Throughout 20000 prints, the image quality or the charge quantity was not substantially changed and was maintained at an appropriate level. The magnetic carrier or the interior of the developing device was hardly contaminated with the dye.

The obtained results are shown in Tables 1 and 2.

EXAMPLE 4

A toner was prepared in the same manner as described in Example 1 except that 1.5 parts by weight of a chromium complex salt dye of naphthoic acid (Bontron E-82 supplied by Orient Kagaku) was used as the charge-controlling dye. The surface dye concentration in the obtained toner was $3.1\times10^{-3}$ g/g, the median diameter based on the volume was 11.0 μm, the dispersion ($D_{25}/D_{75}$) was 1.55, and the circularity was 0.96. The printing test was carried out in the same manner as described in Example 1. Throughout 20000 prints, the image quality or the charge quantity was not substantially changed and was maintained at an appropriate level. The magnetic carrier or the interior of the developing device was hardly contaminated with the dye.

The obtained results are shown in Tables 1 and 2.

EXAMPLE 5

A resin solution was prepared by dissolving and dispersing 100 parts by weight of a styrene/acrylic copolymer, 8 parts by weight of grafted carbon black, 1 part by weight of a chromium complex salt azo dye (Bontron S-34 supplied by Orient Kagaku) as the charge-controlling dye and 0.5 part by weight of low-molecular-weight polypropylene (Biscol 550P supplied by Sanyo Kasei) in toluene, and the resin solution was spray-granulated by the spray-drying method to form a toner. The surface dye concentration in the obtained toner was $1.9\times10^{-3}$ g/g, the median diameter based on the volume was 7.1 μm, the dispersion ($D_{25}/D_{75}$) was 1.51, and the circularity was 0.96. The printing test was carried out in the same manner as described in Example 1. Throughout 20000 prints, the image quality or the charge quantity was not substantially changed and was maintained at an appropriate level. The magnetic carrier or the interior of the developing device was hardly contaminated with the dye.

The obtained results are shown in Tables 1 and 2.

COMPARATIVE EXAMPLE 1

By a Henschel mixer, 100 parts by weight of a styrene/acrylic copolymer was mixed with 8 parts by weight of grafted carbon black, 1.5 parts by weight of a chromium-containing complex salt azo dye (Bontron S-34 supplied by Orient Kagaku) as the charge-controlling dye and 0.5 part of low-molecular-weight polypropylene (Biscol 550P supplied by Sanyo Kasei), and the mixture was melt-kneaded by a twin-screw extruder. The kneaded mixture was cooled, pulverized and classified to obtain a toner having a median diameter based on the volume of 9.5 μm, a dispersion ($D_{25}/D_{75}$) of 1.45 and a circularity of 0.79. The obtained toner was immersed and stirred in methanol in the same manner as described in Example 1, whereby the surface dye concentration was adjusted to $2.3\times10^{-3}$ g/g. When the printing test was carried out in the same manner as described in Example 1, the magnetic carrier or the interior of the developing device was hardly contaminated with the dye, but image fogging and reduction of the resolving power were observed and scattering of the toner was caused.

The obtained results are shown in Tables 1 and 2.

COMPARATIVE EXAMPLE 2

A toner was prepared in the same manner as described in Example 1 except that the immersion and stirring treatment in methanol was not carried out. The surface dye concentration in the obtained toner was $4.3\times10^{-3}$ g/g, the median diameter based on the volume was 9.8 μm, the dispersion ($D_{25}/D_{75}$) was 1.45, and the circularity was 0.98. When the printing test was carried out in the same manner as described in Example 1, image fogging was caused with advance of the copying operation. The surface of the magnetic carrier was conspicuously contaminated with the dye, and scattering of the toner was observed under high temperature and high relative humidity conditions.

The obtained results are shown in Tables 1 and 2.

COMPARATIVE EXAMPLE 3

A toner having a surface dye concentration of $0.8\times10^{-3}$ g/g was prepared in the same manner as described in Example 1 except that the immersion and stirring treatment in methanol was excessively carried out. In the obtained toner, the median diameter based o the volume was 9.8 μm, the dispersion ($D_{25}/D_{75}$) was 1.48, and the circularity was 0.98. When the printing test was carried out in the same manner as described in Example 1, image fogging and reduction of the image density were caused with advance of the copying operation.

The obtained results are shown in Tables 1 and 2.

As is apparent from the data shown in Tables 1 and 2, the change of the charge quantity in the toner of the present invention is very small and the developing property is stable, and therefore, the toner of the present invention gives good images having a high image density and a high resolving power with no fogging under either normal temperature and normal relative humidity conditions or high temperature and high relative humidity conditions. Moreover, the contamination of a frictional member such as a carrier or the interior of a developing device is controlled to a level much lower than in case of the comparative toners. Furthermore, it is understood that if the immersion washing treatment in an organic solvent is carried out, the durability and environmental resistance are further improved.

As is apparent from the foregoing description, according to the present invention, by appropriately adjusting the particulate form of the toner and the surface

TABLE 1

(20° C. 60% RH)

| | Example 1 | Example 2 | Example 3 | Example 4 | Example 5 | Comp. Example 1 | Comp. Example 2 | Comp. Example 3 |
|---|---|---|---|---|---|---|---|---|
| Surface dye concentration ($\times10^{-3}$ g/g) | 2.6 | 2.5 | 2.9 | 3.1 | 1.9 | 2.3 | 4.3 | 0.8 |
| Circularity | 0.98 | 0.99 | 0.99 | 0.96 | 0.96 | 0.79 | 0.98 | 0.98 |
| Median diameter based on volume (μm) | 9.8 | 10.2 | 8.9 | 11.0 | 7.1 | 9.5 | 9.8 | 9.8 |
| Particle size dispersion $D_{25}/D_{75}$ | 1.47 | 1.46 | 1.52 | 1.55 | 1.51 | 1.45 | 1.45 | 1.46 |
| Immersion washed treatment in solvent | effected | not effected | effected | effected | not effected | effected | not effected | effected |
| Initial Stage | | | | | | | | |
| image density | 1.47 | 1.41 | 1.43 | 1.39 | 1.42 | 1.43 | 1.44 | 1.40 |
| fog density | 0.002 | 0.002 | 0.003 | 0.002 | 0.002 | 0.005 | 0.003 | 0.005 |
| resolving power (lines/mm) | 5.6 | 5.6 | 6.3 | 5.6 | 5.6 | 4.5 | 5.6 | 5.0 |
| scattering to toner | not observed | not observed | not observed | not observed | not observed | slightly observed | not observed | slightly observed |
| toner charge quantity (μc/g) | −27.5 | −25.9 | −28.5 | −29.2 | −23.5 | −12.5 | −26.5 | −19.8 |
| 20000 Prints | | | | | | | | |
| image density | 1.49 | 1.43 | 1.42 | 1.38 | 1.45 | 1.35 | 1.33 | 1.29 |
| fog density | 0.003 | 0.003 | 0.003 | 0.003 | 0.003 | 0.010 | 0.009 | 0.011 |
| resolving power (lines/mm) | 5.6 | 5.6 | 6.3 | 5.0 | 5.0 | 4.0 | 4.5 | 4.5 |
| scattering of toner | not observed | not observed | not observed | not observed | not observed | observed | slightly observed | observed |
| toner charge quanity (μc/g) | −26.5 | −24.5 | −27.2 | −29.8 | −21.3 | −10.8 | −15.8 | −14.8 |

TABLE 2

(35° C. 85% RH)

| | Example 1 | Example 2 | Example 3 | Example 4 | Example 5 | Comp. Example 1 | Comp. Example 2 | Comp. Example 3 |
|---|---|---|---|---|---|---|---|---|
| Surface dye concentration ($\times10^{-3}$ g/g) | 2.6 | 2.5 | 2.9 | 3.1 | 1.9 | 2.3 | 4.3 | 0.8 |
| Circularity | 0.98 | 0.99 | 0.99 | 0.96 | 0.96 | 0.79 | 0.98 | 0.98 |
| Median diameter based on volume (μm) | 9.8 | 10.2 | 8.9 | 11.0 | 7.1 | 9.5 | 9.8 | 9.8 |
| Particle size dispersion $D_{25}/D_{75}$ | 1.47 | 1.46 | 1.52 | 1.55 | 1.51 | 1.45 | 1.45 | 1.46 |
| Immersion washed treatment in solvent | effected | not effected | effected | effected | not effected | effected | not effected | effected |
| Initial Stage | | | | | | | | |
| image density | 1.46 | 1.40 | 1.40 | 1.38 | 1.41 | 1.42 | 1.35 | 1.39 |
| fog density | 0.003 | 0.003 | 0.003 | 0.003 | 0.003 | 0.007 | 0.005 | 0.006 |
| resolving power (lines/mm) | 5.6 | 5.6 | 6.3 | 5.0 | 5.0 | 4.0 | 4.5 | 4.5 |
| scattering of toner | not observed | not observed | not observed | not observed | not observed | observed | not observed | observed |
| toner charge quantity (μc/g) | −25.6 | −24.5 | −27.2 | −27.9 | −21.5 | −11.3 | −23.2 | −19.8 |
| 20000 Prints | | | | | | | | |
| image density | 1.44 | 1.41 | 1.39 | 1.32 | 1.35 | 1.29 | 1.23 | 1.19 |
| fog density | 0.003 | 0.004 | 0.003 | 0.004 | 0.003 | 0.016 | 0.012 | 0.013 |
| resolving power (lines/mm) | 5.6 | 5.0 | 5.6 | 5.0 | 5.0 | 4.0 | 4.0 | 4.0 |
| scattering of toner | not observed | not observed | not observed | not observed | not observed | observed | observed | observed |
| toner charge quanity (μc/g) | −24.9 | −23.5 | −26.1 | −26.5 | −19.8 | −9.8 | −11.9 | −12.8 |

dye concentration, the charging stability can be improved while preventing falling of the charge-controlling dye, and a toner having excellent chargeability, durability, environmental stability and developing property can be obtained and a high-quality image can be formed.

I claim:

1. A toner for developing statically charged images, which comprises a binder resin and, dispersed therein, at least a colorant and a charge-controlling dye, wherein the toner consists of spherical particles having a circularity, defined by the following formula (1), of from 0.95 to 1:

$$\text{Circularity } (D) = \frac{\sqrt{r_L \cdot r_S}}{r_L} \quad (1)$$

wherein $r_L$ represents the long radius of the toner particles and $r_S$ represents the short radius of the toner particles, and the surface dye concentration is from $1\times10^{-3}$ to $4\times10^{-3}$ g/g, said surface dye comprising dye remaining after treatment of said spherical particles in an organic solvent in which free surface dye is soluble.

2. A toner as set forth in claim 1, wherein the dye adheres uniformly to the surfaces of the particles.

3. A toner as set forth in claim 1, wherein the dye is a metal-containing complex salt compound.

4. A toner as set forth in claim 3, wherein the metal-containing complex salt compound is a metal complex salt of salicylic acid or an alkylsalicylic acid.

5. A toner as set forth in claim 3, wherein the metal-containing complex salt compound is a metal complex salt of an azo dye.

6. A toner as set forth in any of claims 1 through 5, wherein the median diameter based on the volume of the spherical particles is 5 to 11 μm and $D_{25}/D_{75}$ indicating the dispersion of the particle size is from 1.2 to 1.6.

7. A toner as set forth in any of claims 1 through 5, wherein the spherical particles are polymer particles prepared directly by suspension polymerization.

8. A process for the preparation of a toner for developing statically charged images, which comprises forming spherical particles comprising a binder resin and, dispersed therein, at least a colorant and a charge-controlling dye and having a circularity, defined by the following formula (1), of from 0.95 to 1:

$$\text{Circularity } (D) = \frac{\sqrt{r_L \cdot r_S}}{r_L} \quad (1)$$

wherein $r_L$ represents the long radius of the toner particles and $r_S$ represents the short radius of the toner particles, immersing the spherical particles in an organic solvent capable of dissolving or dispersing the charge-controlling dye therein but incapable of dissolving the resin component therein, and thereby causing the charge-controlling dye to uniformly adhere to the entire surfaces of the particles while washing away the unnecessary portion of the charge-controlling dye present on the surfaces of the particles, wherein the dye concentration on the surfaces of the final particles is adjusted to $1.0\times10^{-3}$ to $4\times10^{-3}$ g/g.

9. A process according to claim 8, wherein the spherical particles having a circularity within said range be polymer particles obtained by suspending a polymerizable composition comprising at least a polymerizable monomer, a colorant and a charge-controlling dye in an amount of at least 0.1% by weight based on the polymerizable monomer in an aqueous phase and subjecting the suspension to polymerization reaction, which have a median diameter based on the volume of from 5 to 11 μm and $D_{25}/D_{75}$, indicating the dispersion of the particle diameter, of from 1.2 to 1.6.

* * * * *